United States Patent [19]

Dixit et al.

[11] Patent Number: 5,075,027

[45] Date of Patent: Dec. 24, 1991

[54] THIXOTROPIC AQUEOUS SCENTED AUTOMATIC DISHWASHER DETERGENT COMPOSITIONS

[75] Inventors: Nagaraj S. Dixit, Kendall Park; Thomas Davan, E. Brunswick, both of N.J.

[73] Assignee: Colgate Palmolive Co., Piscataway, N.J.

[21] Appl. No.: 536,150

[22] Filed: Jun. 8, 1990

Related U.S. Application Data

[63] Continuation of Ser. No. 307,659, Feb. 6, 1989, abandoned.

[51] Int. Cl.[5] ..... C11D 13/08; C11D 3/50; C11D 3/395; C11D 3/08

[52] U.S. Cl. ..... 252/174.11; 252/89.1; 252/173; 252/135; 252/174.15; 252/94; 252/95; 252/97; 252/103; 252/134.16; 252/174.25; 252/DIG. 10; 252/DIG. 14; 252/DIG. 19

[58] Field of Search ..... 252/95, 99, 102, 173, 252/174.11, 95, 99, 102, 173, 174.11, 89.1, 135, 174.15, 94, 97, 103, 174.16, 174.25, DIG. 10, DIG. 14, DIG. 19

[56] References Cited

U.S. PATENT DOCUMENTS

| | | | |
|---|---|---|---|
| 3,684,722 | 8/1972 | Hynam | 252/99 |
| 3,876,551 | 4/1975 | Laufer | 252/9.8 |
| 4,113,645 | 9/1978 | DeSimone | 252/95 |
| 4,115,308 | 9/1978 | Guerry | 252/135 |
| 4,116,849 | 9/1978 | Leikhin | 252/103 |
| 4,240,919 | 12/1980 | Chapman | 252/95 |
| 4,695,394 | 8/1987 | Choy | 252/97 |
| 4,740,327 | 4/1988 | Julemont | 252/103 |
| 4,828,723 | 5/1989 | Cao | 252/8.8 |

*Primary Examiner*—Paul Lieberman
*Assistant Examiner*—Kevin D. McCarthy
*Attorney, Agent, or Firm*—Richard Nanfeldt; Murray M. Grill; Robert C. Sullivan

[57] ABSTRACT

A scented aqueous thixotropic dishwasher composition comprising tripolyphosphate, a chlorine bleach compound, a thixotropic thickener, a chlorine bleach stable fragrance and air in an amount of 2% to 10% by volume. The composition preferably also contains a long chain fatty acid or its salt, an organic detergent active material, a foam depressant and an alkali metal carbonate. Also disclosed is a process for preparing aqueous thixotropic dishwater detergent compositions having improved physical stability by entraining air into the composition in an amount such that the bulk and liquid phase specific gravities of the dishwasher detergent composition are approximately equal.

43 Claims, 1 Drawing Sheet

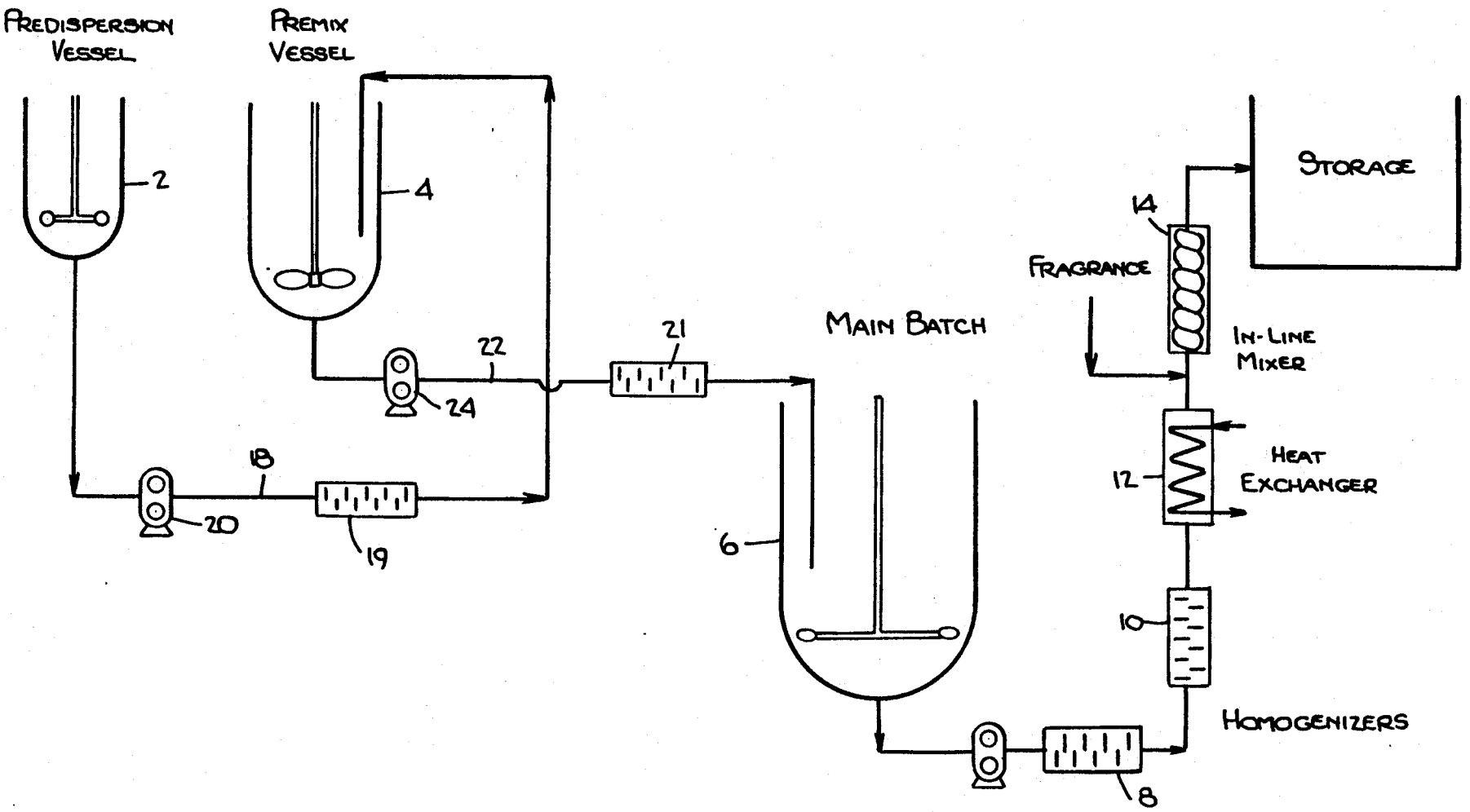
Storage
In-Line Mixer
Heat Exchanger
Homogenizers
14
Fragrance
12
10
8
Main Batch
6
21
22
24
4
Premix Vessel
19
18
20
2
Redispersion Vessel

THIXOTROPIC AQUEOUS SCENTED AUTOMATIC DISHWASHER DETERGENT COMPOSITIONS

This is a continuation of application Ser. No. 07/307,659 filed Feb. 6, 1989, now abandoned.

FIELD OF INVENTION

The present invention relates generally to the formulation of scented liquid automatic dishwashing detergent compositions and particularly to a method of preparing scented liquid automatic dishwashing detergent compositions having thixotropic properties and improved physical stability.

BACKGROUND OF THE INVENTION

Recent research and development activity has focused on paste-form, gel-like and thixotropic forms of liquid automatic dishwasher detergents because of the desirable advantages to the consumer over conventional powdered forms of detergents. These advantages include ease of dispensing from the container, lower volume consumption per wash load because of higher concentrations of active ingredients, and long term storage without moisture spoilage.

The development of suitable liquid automatic dishwasher detergents has not been without its problems due to the requirement that such formulations incorporate a number of ingredients which are generally incompatible, i.e., they tend to react with each other prior to use in the dishwasher. Additionally, liquid automatic dishwasher detergents should also exhibit thixotropic properties, i.e., it should be highly viscous in a quiescent state and have relatively high yield values (Bingham Plastic), but when subjected to a shear stress, such as being squeezed through a orifice, it should have flow properties similar to a viscous liquid so it can be easily dispensed into a dishwasher detergent dispenser cup. Once inside the dispenser cup it should quickly revert to the high viscosity/Bingham plastic state.

Another common problem with liquid automatic dishwashing detergent compositions is that they tend to separate into substantially solid and liquid phases during the shelf life of the product. Improvement in the phase stability has been accomplished by the addition of clays, polymers, soaps or combinations of clays and soaps. However, a drawback of this approach is that any addition to the detergent composition may adversely affect the rheological properties of the detergent composition.

Similarly, addition of a fragrance to a liquid automatic dishwasher detergent to impart a desirable scent has also been problematical because of the effect on the complex balance of ingredients within the composition necessary to produce the desired rheology and other physical characteristics. For example, the presence of a chlorine releasing compound would be expected to have a detrimental effect on an oil-type fragrance that is readily oxidized. In addition, the presence of oil-like fragrances would be expected to have an adverse effect on the phase stability of such compositions because of their tendency to act as defoamers.

SUMMARY AND OBJECTS OF THE INVENTION

It is an object of the present invention to provide scented thixotropic liquid automatic dishwasher detergent compositions having improved physical stability.

It is another object of the present invention to provide a novel process whereby liquid automatic dishwasher detergent compositions having thixotropic properties can be produced which are physically stable and not prone to separation during extended periods of storage.

It is a further object of the present invention to provide a novel process whereby air is entrained in a thixotropic liquid automatic dishwasher detergent composition so as to maintain stability for extended periods of storage.

It is a still further object of the present invention to provide a novel process whereby a fragrance is introduced to a liquid automatic dishwasher detergent composition to impart a pleasant scent to the composition without adversely affecting the phase stability or rheological properties.

The present invention provides a scented liquid automatic dishwasher detergent composition having thixotropic properties and improved long term physical stability. According to the invention, the scented liquid automatic dishwasher detergent compositions generally contain:

(1) alkali metal tripolyphosphates to soften or tie up hard-water minerals and to emulsify and/or peptize soil;

(2) sodium silicate to supply the alkalinity necessary for effective detergency and to provide protection for fine china glaze and pattern;

(3) alkali metal carbonate, generally considered to be optional, to enhance alkalinity;

(4) a chlorine-releasing agent to aid in the elimination of soil specks which lead to water spotting;

(5) chlorine bleach stable defoamer to reduce foam, thereby enhancing machine efficiency and supplying additional detergency;

(6) chlorine bleach stable surfactant, sometimes referred to as detergent active material, which is compatible with the other ingredients and provides for detergency; (7) thixotropic thickener in an amount effective to provide the composition with a thixotropy index of about 2.0 to 10;

(8) caustic, as necessary, to adjust the pH to within the range of about 10 to 14;

(9) a long chain fatty acid or salt of a long chain fatty acid as a physical stabilizer in an amount effective to increase the physical stability of the composition;

(10) fragrance in an amount effective to impart a pleasant scent to the composition without adversely affecting the stability or thixotropic properties of the composition;

(11) water in an amount effective to avoid destruction of the desired thixotropic properties; and

(12) air in an amount ranging from about 2% to 10% by volume, effective to provide the composition with a bulk specific gravity of about 1.20 to about 1.35.

The present invention provides a process for manufacturing liquid automatic dishwasher detergent compositions having a bulk specific gravity about equal to the liquid phase specific gravity and exhibiting improved physical stability and rheological properties, comprising the steps of:

(a) forming a predispersion mix containing water, physical stabilizer, defoamer and surfactant;

(b) forming a thickener premix containing the predispersion mix of step (a), water and a thixotropic thickener and mixing the thickener premix until the thickener is hydrated and deagglomerated;

(c) high-shear mixing the thickener premix from step (b) and additional water while adding other desired detergent ingredients to form a liquid automatic dishwasher detergent composition, containing about 2 to 10% by volume air, and (d) homogenizing the liquid automatic dishwasher detergent composition to effect on equilibration of the bulk and liquid phase specific gravities of the composition.

The process of the present invention may be carried out under conditions which ensures that the thixotropic liquid automatic dishwasher composition achieves an extremely high stable condition. It has been found that this condition is reached when about 2% to about 10% by volume of air is entrained in the composition and the bulk specific gravity of the composition is about equal to the liquid phase specific gravity of the composition.

The present invention also provides a process whereby a fragrance is added to the liquid automatic dishwasher detergent composition under conditions and in an amount so as not to adversely affect the thixotropic properties or physical stability of the composition. For example, the process proceeds in which the liquid automatic dishwasher detergent composition from step (d) above is first cooled to a maximum temperature less than about 85° F. and thereafter the liquid automatic dishwasher detergent composition and the desired fragrance are introduced to a mixer wherein the fragrance is uniformly dispersed throughout the final liquid automatic dishwasher detergent product.

Thus, the present invention provides a process for combining ingredients in proportions so as to provide a liquid automatic dishwasher detergent product having an improved combination of properties, particularly thixotropy and phase stability.

DESCRIPTION OF THE DRAWING AND TERMS

The drawing is an elevational schematic of the preferred process of the present invention.

The term "bulk specific gravity", as used herein, refers to the specific gravity of a homogeneous liquid automatic detergent composition including all required ingredients. The term "liquid phase specific gravity" as used herein, refers to the specific gravity, as measured by conventional techniques, of a liquid removed centrifugally from the liquid automatic detergent composition, i.e., bulk composition.

The term "thixotropy index" is the ratio of viscosities measured at 3 rpm and 30 rpm at room temperature after 3 minutes using a Brookfield HATDV II viscometer with a #4 spindle.

DETAILED DESCRIPTION OF THE INVENTION

The present invention is directed to a liquid automatic detergent composition including a fragrance which does not adversely affect the thixotropic properties and long term phase stability of the composition. The present invention is also directed to a process for producing liquid automatic detergent compositions having thixotropic properties and improved long term phase stability wherein air is entrained into the composition in an amount from about 2% to 10% by volume so as to effect an equilibration of the bulk and liquid phase specific gravities of the composition. Moreover, the present invention is also directed to a process for incorporating a fragrance into the liquid automatic detergent composition without adversely affecting the rheological properties or long term phase stability of the composition.

A preferred example of the present invention provides for a composition scented with fragrance comprising the following ingredients on a weight basis unless specified otherwise:

(a) 5 to 35% alkali metal tripolyphosphate;
(b) 2.5 to 20% sodium silicate;
(c) 0 to 9% alkali metal carbonate;
(d) 0.1 to 5% chlorine bleach stable, water dispersible organic detergent active material;
(e) 0.01 to 5% chlorine bleach stable foam depressant;
(f) chlorine bleach compound in an amount to provide about 0.2 to 4% of available chlorine;
(g) thixotropic thickener in an amount sufficient to provide the composition with a thixotropy index of about 2.0 to 10;
(h) alkali metal hydroxide, as necessary, to adjust the pH from about 10 to 14;
(i) a long chain fatty acid or its salt as a physical stabilizer in an amount effective to increase the physical stability of the composition;
(j) fragrance in an amount effective to provide a scent and to avoid destruction of the desired thixotropy and physical stability of the composition;
(k) water in an amount effective to avoid destruction of the desired thixotropic properties; and
(l) air in an amount ranging from about 2% to 10% by volume, effective to provide the composition with a bulk specific gravity of about 1.20 to about 1.35.

According to the process of the present invention, a phase stable, thixotropic liquid automatic detergent composition is produced by entraining air into the composition so as to effect an equilibration of the specific gravities of the bulk and liquid phases of the composition.

It has been found that concentrated dispersions which contain both liquid and solid phases, such as the liquid automatic dishwasher detergent compositions, can be stabilized by dispersing an appropriate amount of air in the form of micron size bubbles throughout the liquid phase of the composition. It has also been found that the air can be dispersed and stabilized as bubbles throughout the liquid phase by employing a stabilizing system comprising components categorized generally as, physical stabilizers, foam depressants or defoamers and surfactants. While not wishing to be bound by any theory to explain how the stabilizing system and air interact in the liquid automatic dishwasher detergent compositions, it is believed that the stabilizing components interact at the air/liquid interface such that the hydrophobic groups of these components are oriented towards the air bubbles while the hydrophilic groups are oriented towards the aqueous phase. The hydrophilic groups, in turn, interact with the solid particles of the suspension either through hydrogen bonding or through electrostatic interaction. In other words, the liquid/air interface consists of the stabilizing system components and solid particulates giving rise to a liquid crystalline type structure for the interphace.

According to the preferred process of the present invention, a three-part stabilizing system produces a highly stable liquid automatic dishwasher detergent composition by stabilizing the micron size air bubbles throughout the composition such that the bulk specific gravity of the liquid automatic dishwasher detergent composition is about equal to the specific gravity of the liquid phase only, in the liquid automatic dishwasher detergent composition. It is at this condition that the liquid automatic dishwasher detergent composition exhibits high stability, i.e., there is little or no tendency for phase separation due to density variations in the composition.

In order to effectively disperse the air throughout the liquid automatic dishwasher detergent composition it has been discovered that the size of the entrained air bubbles must be greater than the size of any dispersed solid particles. The bubble size generally may vary from about 5 to about 80 microns and preferably from about 20 to about 60 microns. Air bubble size can be controlled, generally, by varying the blade tip speed of the dispersers or agitators during the mixing operations. It has also been found that air entrainment from about 2 to about !0% by volume produced phase stable compositions, the preferred range being from about 4.0 to about 9.0% by volume, the most preferred range being from about 6.5 to about 8.5% by volume.

As best seen in the drawing, the process of the present invention can be performed in a blending system incorporating predispersion vessel 2, premix vessel 4, main batch vessel 6, homogenizers 8, 10, 19 and 21, heat exchanger 12, in-line mixer 14 and storage tank 16.

A predispersion mix comprising the stabilizing system is prepared in predispersion vessel 2 then fed to the premix vessel 4 through line 18 and homogenizer 19 via pump 20 where it is added to a thixotropic thickener to prepare a thickener premix. The thickener premix is then fed to the main batch vessel 6 through line 22 and homogenizer 21 via pump 24 wherein the remaining components of the liquid automatic detergent composition are added.

The detergent composition from vessel 6 is then fed through homogenizers 8 and 10 and thereafter cooled in the exchanger 12. If a scented dishwasher detergent composition is desired, the cooled product is fed through an in-line static mixer 14 where a fragrance is added. The liquid dishwasher detergent composition is then fed to tank 16 where it is stored.

In the preferred process of the present invention, a liquid detergent predispersion mix is first prepared including the selected physical stabilizer, foam depressant and surfactant components of the liquid automatic dishwasher detergent composition as well as a portion of the total liquid automatic dishwasher detergent water content. Depending on the selection of stabilizing components, one or more of the components may initially be solid, requiring either the addition of heat to form a melt or the addition of water to form a solution or emulsion. The amount of water added to the predispersion mix should be limited so as to maintain a highly viscous mix. The predispersion mix is subjected to mixing, preferably high-shear mixing for about 5 minutes during which time the predispersion mix temperature may exceed 100° F. High-shear mixing, as used herein, is defined in terms of shear rates and is dependent on a number of variables, the most important being the configuration of the mixing vessel and the impeller tip speed. For example, the pre-dispersion mix is preferably high shear mixed in a Myers HSD TM using an 8 inch impeller at an impeller speed of about 4500 ft/min. The "high shear" rate at this condition is approximated to be of the order of 100 $sec^{-1}$.

The predispersion mixing step may be accomplished in other conventional milling or high-shear mixing equipment, for example, roller mills, colloid mills and Premier mills.

The predispersion mixing step is followed by a second mixing step during which a thixotropic thickener, e.g., clay, and an additional portion of the total liquid automatic dishwasher detergent water content is added to the predispersion mix to form a thickener premix. The thickener premix is preferably subjected to low-shear mixing for about 20 minutes during which time the thickener is hydrated, deagglomerated and dispersed throughout the thickener premix. Low-shear mixing, as used herein, is also defined in terms of shear rates and as discussed above with respect to high shear is a function of a number of variables including mixing vessel configuration and impeller tip speed. Equipment suitable for low-shear mixing of the thickener premix includes conventional paddle blade mixers wherein average shear rates are on the order of about 10 $sec^{-1}$.

The amount of water added to each of the first two mixing steps is somewhat arbitrary within the limits of the total water content of the final liquid automatic dishwasher detergent composition. However, it has been found that the amount of water added to the predispersion mix should not be so high as to produce an unduly low viscosity and high fluidity mixture since such a condition would adversely affect the mixing, particularly under high-shear mixing conditions.

The second mixing step is followed by a main batch mixing step during which the thickener premix, the balance of the total liquid automatic dishwasher detergent water content and other desired liquid automatic dishwasher detergent ingredients are mixed, preferably under high-shear conditions to form a main batch composition. During this mixing step the remaining liquid automatic dishwasher detergent ingredients are preferably added. Shear rates on the order of 100 $sec^{-1}$ are achieved during the main batch mixing step. The remaining liquid dishwasher detergent ingredients which may be added include the following: sodium hydroxide, sodium carbonate, silicates, alkali metal tripolyphosphates, chlorine bleach compounds, and other suitable ingredients which comprise the desired liquid automatic dishwasher detergent composition. Equipment suitable for the high-shear mixing operation include roller mills, collold mills, Premier mills and Myers HSD, among others.

The main batch composition from the high-shear mixing step is then subjected to a series of course and fine homogenizing steps until the solid and liquid phases of the liquid automatic dishwasher detergent composition are thoroughly homogenized. The homogenizing steps are carried out under high-shear conditions wherein shear rates of the order of about $10^4$ $sec^{-1}$ is achieved. The homogenizing step is complete when the bulk specific gravity of the liquid automatic dishwasher detergent composition is about equal to the specific gravity of the automatic dishwasher detergent liquid phase only. Homogenization of the liquid automatic dishwasher detergent composition may be accomplished in conventional homogenizers, such as a high speed Dispax TM, available from IKA-Works, Inc.

According to the invention, the dishwasher detergent composition is preferably subjected to mixing at a rate and a duration which ensures air entrainment in an amount of about 2% to about 10% by volume, preferably 4 to 9% and most preferably 6.5 to 8.5% by volume in the dishwasher composition. In the preferred embodiment of the invention, the air is entrained into the composition during the high shear mixing of the dishwasher detergent ingredients. However, according to the invention air may be introduced to the composition at any point in the process by conventional means to produce a phase stable composition.

The presence of a bulk specific gravity about equal to the liquid phase specific gravity is indicative of air entrainment and high product stability. Generally, it has been found that specific gravities within the range of 1.20 to 1.35 provide a phase stable liquid automatic dishwasher detergent composition, the preferred specific gravity being within the range from about 1.26 to about 1.32.

According to a more preferred embodiment of the invention, a fragrance is added to the liquid automatic dishwasher detergent composition subsequent to the coarse and fine homogenizing steps described above. In this embodiment, the liquid automatic dishwasher detergent composition is cooled and thereafter the liquid automatic dishwasher detergent composition and the desired fragrance are mixed, preferably in a static mixer, to produce a physically stable and uniformly dispersed scented liquid automatic dishwasher detergent product. According to this embodiment of the invention, the liquid automatic dishwasher detergent composition is preferably cooled to a temperature less than about 85° F. prior to introduction of the desired fragrance. It has been found that the addition of the desired fragrance prior to cooling has a detrimental effect on the specific gravity of the liquid automatic dishwasher detergent composition which, in turn, affects the phase stability of the composition. It has also been found that introduction of the fragrance prior to homogenizing, i.e., during the main batch preparation, has resulted in a product having poor physical stability, i.e. the liquid automatic dishwasher detergent composition begins to phase separate almost immediately upon standing. It has also been found that fragrance addition in amounts ranging from about 0.01 to about 0.4% by weight produces a desirable fragrance without adversely affecting the rheological properties or phase stability of the composition, the preferred fragrance addition being from about 0.02 to 0.2% by weight.

While the process of the invention has been described in terms of preferred ingredients and amounts, it would be understood to those skilled in the art that a highly stable thixotropic detergent composition could be achieved in the absence of one or more of the ingredients by appropriate adjustment of the remaining ingredients. For example, it may be possible to formulate a phase stable composition in the absence of a foam depressant by minimizing the surfactant level and increasing the amount of physical stabilizer in the composition.

The liquid automatic detergent compositions produced by the process of the present invention generally are formulated with the ingredients in the proportions described in detail below.

Any linear, branched, polymeric or polybasic, saturated or unsaturated long chain fatty acid may be used as the physical stabilizer according to the present invention. The fatty acid is preferably linear and saturated, having from about 10 to about 22 carbon atoms, preferably from about 10 to 20 carbon atoms, and most preferably from about 14 to 18 carbon atoms, inclusive of the carbon atom of the carboxyl group of the fatty acid. Mixtures of fatty acids may be used, such as those derived from natural sources, such as tallow fatty acid, coco fatty acid, soya fatty acid, etc., or from synthetic sources available from industrial manufacturing processes.

Examples of the fatty acids which can be used as physical stabilizers include, for example, decanoic acid, dodecanoic acid, palmitic acid, myristic acid, stearic acid, behenic acid, oleic acid, eicosanoic acid, tallow fatty acid, coco fatty acid, soya fatty acid, etc. and mixtures of these acids. Behenic acid, stearic acid and mixed fatty acids are preferred. In liquid automatic dishwasher detergent compositions, as well as any other applications where the compositions prepared in accordance with this invention will or may come into contact with articles used for the handling, storage or serving of food products or which otherwise may come into contact with or be consumed by people or animals, the use of the fatty acids as the physical stabilizing agent are of particular advantage because of their known low toxicity. For this purpose, the stearic acid and behenic acid are especially preferred. Another distinct advantage of the use of the fatty acids as stabilizers is their lower cost as compared to the fatty acid metal salts.

The amount of physical stabilizer required to achieve the desired enhancement of physical stability will depend on such factors as the nature of the fatty acid, the nature and amount of the thixotropic agents, detergent active compounds (surfactants), inorganic salts, especially tripolyphosphates (TPP) and other liquid automatic dishwasher detergent ingredients, as well as the anticipated storage and shipping conditions.

Salts of the above fatty acids may also be used as physical stabilizers, e.g. alkali, alkaline earth and polyvalent metal salts. The alkali metal salts include sodium, potassium and ammonium salts of the fatty acids. The alkaline earth salts include calcium, barium and strontium salts of the fatty acids. Examples of the fatty acids from which the polyvalent metal salt stabilizers can be formed include, for example, decanoic acid, dodecanoic acid, palmitic acid, myristic acid, stearic acid, oleic acid, eicosanoic acid, tallow fatty acid, coco fatty acid, soya fatty acid and mixtures of these acids. Stearic acid and mixed fatty acids are the preferred fatty acids from which polyvalent metal salt stabilizers can be formed.

The preferred polyvalent metals are the metals of Groups IIA, IIB and IIIB, particularly magnesium, calcium, aluminum and zinc, although other polyvalent metals, including those of Groups IIIA, IVA, VA, IB, IVB, VB, VIB, VIIB and VIII of the Periodic Table of the Elements can also be used. Specific examples of such other polyvalent metals include Ti, Zr, V, Nb, Mn, Fe, Co, Ni, Cd, Sn, Sb, Bi, etc. As discussed above with respect to the selection of safe free fatty acids, the metal salt should also be selected by taking into consideration its toxicity. For this purpose, the calcium and magnesium salts are especially preferred because they are generally recognized as safe food additives.

The metal salts described above are generally commercially available but can also be easily produced, for example, by saponification of fats and oils, e.g. animal fat, or by neutralization of free fatty acids with an hydroxide or oxide of the polyvalent metal e.g. alumina, alum, etc. Alternatively, metal salts of fatty acids may be produced by the reaction of a soluble metal salt with a soluble fatty acid salt.

Calcium stearate, i.e., calcium distearate, magnesium stearate, i.e., magnesium distearate, aluminum stearate, i.e., aluminum mono stearate, aluminum distearate, aluminum tristearate and mixtures thereof, and zinc stearate, i.e., zinc distearate, are the preferred polyvalent fatty acid salt stabilizers.

The amount of fatty acid or fatty acid salt stabilizers necessary to achieve the desired enhancement of physical stability will depend on such factors as the nature of the fatty acid or its salt, the nature and amount of the thixotropic agent, detergent active compound, inorganic salts, especially TPP, and other liquid automatic dishwasher detergent ingredients, as well as the anticipated storage and shipping conditions.

Generally, however, it has been found that long term stability, i.e., absence of phase separation at low and elevated temperatures, is achieved with the addition of free fatty acids or their salts in amounts ranging from about 0.01 to about 1.0% by weight, preferably from about 0.06 to about 0.8 percent and most preferably from about 0.08 to about 0.4% by weight. In addition, it has been found that the free fatty acids are preferable over their salts primarily because of their ease of dispersibility.

Alternatively, or in addition to the above physical stabilizers, small but effective amounts of polyacrylic acid polymers and copolymers and their salts may be added to improve the physical stability of the compositions. These polymers and their salts are generally commercially available. Suitable polymers are the polyacrylic acids and their sodium salts available from Rohm and Haas as ACRYSOL TM LMW. The proportions of polymer may be in the range of 0.01 to 3% depending on the molecular weight of the polymers, the lower proportions being more suitable for the higher molecular weight polymers.

Foam inhibition during the dishwashing cycle is important to maximize dishwasher efficiency and minimize destabilizing effects which might occur due to the presence of excess foam within the washer. Foam may be sufficiently reduced by suitable selection of the type and/or amount of detergent active material, the main foam-producing component. The degree of foam is also somewhat dependent on the hardness of the wash water in the machine whereby suitable adjustment of the proportions of water softeners, e.g., alkali metal tripolyphosphate, may provide the desired degree of foam inhibition. However, according to the invention, there is preferably included a chlorine bleach stable foam depressant or defoamer as a component of the stabilizing system. Effective defoamers include the alkyl phosphonic acid esters of the formula:

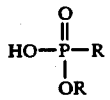

and the alkyl acid phosphate esters of the formula

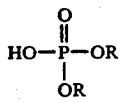

available, for example, from Hooker (SAP) or from American Hoechst as Knapsack (LPKn-158), in which one or both R groups in each type of ester may represent independently a $C_{12-20}$ alkyl group. Mixtures of the two ester types, or any other chlorine bleach stable types, or mixtures of mono-and di-esters of the same type, may also be employed. The preferred inhibitor according to the invention is a mixture of mono- and di-$C_{16-18}$ alkyl acid phosphate esters such as monostearyl/distearyl acid phosphates 1.2/1 (Knapsack LPKn158). In addition, it is an advantageous feature of this invention that many of the stabilizing long chain fatty acids, such as stearic acid and behenic acid act as supplemental foam killers.

The detergent compositions of the invention generally contain a foam depressant in an amount from 0 to about 5% by weight, preferably from about 0.01 to about 5.0% and most preferably from about 0.01 to about 0.5% by weight. In addition the weight ratio of surfactant to foam depressant preferably ranges from about 10:1 to about 1:1, most preferably from about 4:1 to about 1:1.

The detergent active material, i.e., surfactant selected for use in the liquid automatic dishwasher detergent composition of the invention must be stable against chemical decomposition and oxidation by the strong active chlorine bleaching agent also present in the liquid automatic dishwasher detergent composition.

Surfactants useful in the present invention are of either the anionic or non-ionic type or combinations of the two. Preferred surfactants are mono- or di-anionics containing sulfate, sulfonate or carboxylates, as amphiphiles. The most preferred surfactants according to the invention are the linear or branched alkali metal mono- and/or di-($C_{8-14}$)alkyl diphenyl oxide mono and/or disulfonates, commercially available from Dow Chemical, for example as DOWFAX TM 3B-2 and DOWFAX TM 2A-1. In addition, the surfactant should be compatible with the other ingredients of the composition. Other preferred surfactants include the primary alkylsulphates, alkylsulphonates, alkylarylsulphonates, sec.-alkylsulphates and olefin sulfonate. Examples include sodium $C_{10}$–$C_8$ alkanesulphonates such as sodium lauryl sulfonate, sodium hexadecyl-1-sulphonate and sodium $C_{12}$–$C_{18}$ alkylbenzenesulphonates such as sodium dodecylbenzenesulphonates. The corresponding potassium salts may also be employed.

Other suitable surfactants or detergents useful herein include, the amine oxide surfactants of the structure $R_2R^1NO$ in which each R represents a lower alkyl group, for instance, methyl, and $R^1$ represents a long chain alkyl group having from 8 to 22 carbon atoms, for instance a lauryl, myristyl, palmityl or cetyl group. Instead of an amine oxide, a corresponding surfactant phosphine oxide $R_2R^1PO$ or sulphoxide $RR^1SO$ can be employed. Betaine surfactants are typically of the $R_2R^{1N}$—R'COO—, in which each R represents a lower alkylene group having from 1 to 5 carbon atoms. Specific examples of the amino oxide surfactants are lauryldimethylamine oxide, myristyldimethylamine oxide, the corresponding phosphine oxides and sulphoxides, and the corresponding betaines, including dodecyldimethylammonium acetate, tetradecyldiethylammonium pentanoate, hexadecyldimetyhylammonium hexanoate and the like. For biodegradability reasons, the alkyl groups in these surfactants are preferably linear. Detergent compositions according to the invention may contain from 0 to about 5% surfactant by weight, preferably from about 0.1 to about 5% by weight and most preferably from about 0.3 to 2.0% by weight.

Thixotropic agents, i.e., thickeners or suspending agents which produce thixotropic properties in an aqueous medium, are known in the art. These thixotropic agents are water soluble, water dispersible or colloid-forming, organic or inorganic, and monomeric or polymeric. They must be stable in the detergent compositions of the present invention, i.e. stable to high alkalinity and chlorine bleach compounds, such as sodium hypochlorite. The preferred thixotropic agents are the inorganic, colloid-forming clays of smectite and/or attapulgite types. These agents are generally used in amounts of about 0.1 to about 10% by weight to confer the desired thixotropic properties or Bingham plastic behavior to the liquid automatic dishwasher detergent formulations. Other suitable thixotropic agents include small but effective amounts of an aliphatic long chain fatty acid having 8 to 22 carbon atoms or the dimers or trimers thereof. These agents are generally used in amounts ranging from 0.02 to 0.5% by weight. One advantage of the liquid automatic dishwasher detergent formulations of the present invention is that the desired thixotropic properties or Bingham plastic behavior can be obtained in the presence of the aforementioned physical stabilizing system with lesser amounts of the thixotropic thickeners. For example, inorganic colloid-forming clays of the smectite and/or attapulgite types added to the liquid automatic dishwasher detergent compositions of the invention in the amount of about 0 to 3% by weight, preferably 0.2 to 2.5%, most preferably 0.5 to 2.2% by weight, are generally sufficient to achieve the desired thixotropic properties and Bingham plastic character when used in combination with the physical stabilizing system.

The smectite clays include montmorillonite (bentonite), hectorite, saponite, and the like. Montmorillonite clays are preferred and are available under tradenames such as Thixogel TM No. 1 and Gel White TM GP, H, etc., from Georgia Kaolin Company and ECCAGUM TM GP, H, etc., from Luthern Clay Products. Attapulgite clays include the materials commercially available under the tradename Attagel TM, i.e. Attagel TM 40, Attagel TM 50 and Attagel TM 150 from Engelhard Minerals and Chemicals Corporation. Mixtures of smectite and attapulgite types in weight ratios of 4:1 to 1:5 are also useful herein. Thickening or suspending agents of the foregoing types are well known in the art, being described, for example, in U.S. Pat. No. 3,985,668. Abrasives or polishing agents should be avoided in the liquid automatic dishwasher detergent compositions as they may mar the surface of fine dishware, crystal and the like.

The detergent compositions of the present invention may also contain various inorganic builder materials such as alkali metal tripolyphosphates and silicates.

A preferred builder material is sodium tripolyphosphate (NaTPP) which serves to soften hard-water minerals and to emulsify and/or peptize soil. The NATPP employed in the liquid automatic dishwasher detergent compositions of the present invention are in a range of about 5 to about 35% by weight, preferably about 20% to about 30% by weight. The NATPP should preferably be free of heavy metal which tends to decompose or inactivate the preferred sodium hypochlorite and other chlorine bleach compounds. The NaTPP may be anhydrous or hydrated, including the stable hexahydrate with a degree of hydration of 6 corresponding to about 22% by weight of water or more. The NaTPP is available commercially in the anhydrous or hydrated forms under the trademarks Thermphos NW TM and Thermphos NH TM, respectively. Preferred liquid automatic dishwasher detergent compositions have been obtained, for example, when employing a weight ratio of anhydrous to hexahydrated NaTPP in the range of about 0.5:1 to about 2:1, preferably about 1:1.

In compositions where no or low phosphates are desired, other functionally equivalent builder materials may be substituted therefor. For example, 5 to 35% aluminosilicate zeolite may be employed in the compositions of the present invention when the sodium silicate level is increased to 25% or more.

It is preferred that the liquid automatic dishwasher detergent compositions of the present invention include an alkali metal silicate, e.g. sodium silicate, to provide composition alkalinity as well as protection of hard surfaces such as fine china glaze and pattern. The silicate component is present in the liquid automatic dishwasher detergent composition in an amount from 0 to about 50% by weight, preferably about 2.5 to about 20% by weight and most preferably from about 5.0 to about 15.0% by weight. The silicate is generally added in the form of an aqueous solution, preferably having a $Na_2O:SiO_2$ ratio of about 1:2.2 to 1:2.8.

A chlorine bleach compound may be employed in the liquid automatic dishwasher detergent compositions prepared according to the process of the present invention. The source of the chlorine compound is preferably an alkali metal hypochlorite, for example, potassium hypochlorite, lithuim hypochlorite, calcuim hypochlorite, magnesium hypochlorite and most preferably sodium hypochlorite. Other sources of chlorine bleach compounds include dichloro-isocyanurate, dichlorodimethyl hydantoin, and chlorinated TSP, among others. The liquid automatic dishwasher detergent compositions according to the invention should contain sufficient chlorine compounds to provide about 0.2 to 4.0% by weight, preferably about 0.8 to 1.6% by weight of available chlorine, as determined, for example, by acidification of 100 parts of the composition with excess hydrochloric acid. A solution containing about 0.2 to about 4.0% by weight of sodium hypochlorite contains or provides about the same percentage of available chlorine.

As an alternative to the chlorine bleach compound, a stabilized enzyme system may be employed to provide proteolytic and amylolytic enzyme cleaning activity to the dishwasher compositions. The stabilized system preferably contains 0.5 to 2.0% wt. enzyme, 1 to 4% wt. of a water dispersible proteinaceous material selected from the group consisting of casein and collagen, 0.75 to 2% wt. of a boron compound and 1.5 to 4% of an alpha-hydroxy carboxylic acid.

It is preferred that the pH of the liquid automatic dishwasher detergent compositions prepared by the process of the present invention be at least 9.5, preferably about 10 to 14.0 and most preferably about 11.0 to 11.5 measured in a 1% aqueous solution. The liquid automatic dishwasher detergent compositions are adjusted to the desired alkaline level by the addition of an alkali metal hydroxide, e.g., sodium hydroxide. Typical concentrations of sodium hydroxide in the liquid automatic dishwasher detergent compositions range from about 0 to about 6% by weight, preferably 0 to 3.0% by weight. The presence of sodium hydroxide serves the additional function of neutralizing the phosphate or phosphonic acid ester.

An alkali metal carbonate, e.g. sodium carbonate, may also be used in liquid automatic dishwasher detergent compositions prepared according to the process of the present invention. The carbonate serves as a buffer to maintain the desired pH level. Typical concentrations of sodium carbonate in the liquid automatic dishwasher detergent compositions range from about 0 to 9.0% by weight, preferably 2 to 9.0% by weight.

Fragrances useful in the present invention must be stable against chemical decomposition and oxidation by the strong active chlorine bleaching agent also present in the compositions. Fragrances useful in the present invention include those derived from natural sources, such as extracts of botanical matter, e.g. essential oils or from synthetic sources available from industrial manufacturing processes. Examples of bleach-stable fragrance materials useful for imparting a fragrance to the dishwasher detergent composition are p-cresol methyl ether, dihydrolimonene epoxide, dodecene-1,2-epoxide and n-undecyl nitrile, among others. Other examples of suitable bleach stable fragrances are disclosed in U.S. Pat. No. 3,876,551. It should be understood that the fragrance selected must be reasonably stable in a bleach environment, that is, it should not be easily oxidized by the hypochlorite in the detergent composition. This is important for two reasons, first, the hypochlorite loss would exceed the limits of acceptability in a dishwasher detergent product and secondly, the oxidation of the fragrance would reduce the aromatic characteristic of the product and in certain cases may actually result in an unpleasant odor. It has been found that fragrance addition to the compositions in the amount of about 0.01 to 0.40, preferably 0.02 to 0.2% by weight imparts a desirable fragrance without affecting the rheological properties or physical stability of the dishwasher detergent composition.

The amount of water contained in these compositions should, of course, be neither so high as to produce unduly low viscosity and high fluidity, nor so low as to produce unduly high viscosity and low fluidity, the thixotropic properties in either case being diminished or destroyed. The proper amount of water is readily determined by routine experimentation in any particular instance, and generally ranges from about 30 to 75% by weight, preferably from about 35 to 65% by weight. In addition, the water is preferably deionized or softened.

In addition to the components described above, the detergent compositions produced by the process of the present invention may include small amounts of additional ingredients, generally less than 3% by weight of hydrotropic agents such as sodium benzene, toluene, xylene and cumene sulphonates, preservatives, dyestuffs and pigments and, enzymes, all being stable to chlorine bleach and high alkalinity. Especially preferred for coloring are the chlorinated phthalocyanines and polysulphides of aluminosilicate which provide, respectively, pleasing green and blue tints. $TiO_2$ may be employed for whitening or neutralizing off-shades. Silica may be employed as an anti-filming agent in amounts ranging from about 0.1 to 5%.

The liquid automatic dishwasher detergent compositions of this invention are readily employed in a known manner for washing dishes, kitchen utensils and the like in an automatic dishwasher provided with a suitable detergent dispenser, and in an aqueous wash bath containing an effective amount of the composition. While the invention has been particularly described in connection with its application to liquid automatic dishwasher detergents and methods for making same it will be readily understood by one of ordinary skill in the art that the benefits which are obtained by the entrainment of air in a three part stabilizing system, namely increased physical stability of the thixotropic suspension, will apply equally well to other thixotropic suspensions.

The invention may be put into practice in various ways and the preferred embodiment will be described to illustrate the invention with reference to the accompanying example.

EXAMPLE 1

A scented thixotropic liquid automatic detergent composition having the formulation described below, was prepared using the preferred process of the present invention.

| STAGE | COMPONENT | WEIGHT % |
|---|---|---|
| PRE-DISPERSION (I) | Water (Softened) | 41.44 |
| | LPKn 158 TM | 8.84 |
| | Al stearate | 5.52 |
| | Dowfax 3B-2 TM | 44.20 |
| | Total | 100.00 |
| PREMIX (II) | Water (Softened) | 82.37 |
| | Predispersion (I) | 10.43 |
| | Gel White TM H | 7.20 |
| | Total | 100.00 |
| MAIN BATCH (III) | Water (Softened) | 25.69 |
| | Premix (II) | 17.53 |
| | Sodium hydroxide (50% A.I.) | 2.42 |
| | Sodium carbonate | 5.05 |
| | Sodium silicate (43.5% A.I) | 17.42 |
| | Thermphos NH TM | 12.12 |
| | Thermphos NW TM | 12.12 |
| | Sodium hypochlorite (13% A.I) | 7.48 |
| | Subtotal | 99.83 |
| HOMO-GENIZE, COOL & MIX (IV) | Fragrance | 0.17 |
| | Total | 100.00 |

According to the preferred process of the invention, a predispersion mix was prepared in a vessel equipped with a high speed disperser, e.g., Myers HSD TM. The amount of water included in the predispersion vessel was limited so that the mixture remained viscous and susceptible to high shear dispersing. The high shear dispersing was carried out for about 5 to 10 minutes at which point the predispersion mix was pumped through a homogenizer to a premix vessel where the clay thickener and water were added to the predispersion mix under low-shear conditions. A paddle blade type mixer, e.g., baffled crutcher was used in the premix vessel which mechanically deagglomerated the clay as it was hydrated. The preparation of the premix generally lasts for about 20 minutes depending on the mixer speed. The resultant premix was removed and homogenized, then added with water to the main batch vessel where it was subjected to high-shear dispersing using a Myers HSD TM. During the high-shear mixing, the remaining liquid and solid ingredients were sequentially added to the main batch vessel.

As additional ingredients were added, particularly the solid ingredients, the mixture became more viscious and the high speed disperser ground the particles to a fine particle size which, in turn, caused an increase in temperature, i.e. to about 125° F.–150° F. The continuous high shear dispersing also resulted in entrainment of a substantial portion of air. The high shear dispersing continued for a total of about 20 minutes during which visible lumps of solid material disappeared and the particle size of the undissolved particles was reduced so that a phase stable dispersion was formed.

Thereafter, the main batch material was fed through a series of coarse and fine homogenizers, where the material was milled at high speeds for relatively short times to further deagglomerate any remaining solids particles. The resultant product was a phase stable thixotropic liquid automatic dishwasher detergent composition.

When it was desired to add a fragrance to the detergent composition, as in the present example, the main batch material was cooled from the main batch temperature which is generally greater than 100° F., typically, 105° F. to 125° F., to a temperature of about 85° F. or less. The cooled main batch material and fragrance were then fed through a series of in-line static mixers and the resultant product was a scented thixotropic liquid automatic detergent composition.

It has been found that the addition of fragrance to the composition according to this method does not have an adverse effect on the rheological properties of the composition or on the long term phase stability of the composition. The specific gravity, viscosity and phase stability, i.e., phase separation, of the scented detergent composition were measured (Example A). For comparison, a sample of the main batch material (Example B) was removed for analysis prior to the fragrance addition. Specific gravity measurements of the bulk and liquid phases were made by conventional techniques known to those skilled in the art. For example, the specific gravity of the bulk composition was determined by weighing a known volume of the bulk composition and an identical volume of water. The ratio of the bulk composition weight to the weight of the water is termed the "bulk specific gravity."

The liquid phase specific gravity was determined by first loading a sample of the liquid dishwasher composition into a conventional centrifuge, e.g. Ivan Sorvall, then spinning the centrifuge at a speed of about 2000 rpm to remove a sufficient amount of supernatant (clear liquid phase) for weighing.

The centrifugation step requires approximately 1—1 ½ hours to separate a sufficient amount of supernatant for several measurements. Thereafter, the supernatant specific gravity was calculated by dividing the weight of an 8 ml. vial of the supernatant by the weight of an identical volume of water, the ratio being defined as the "liquid phase specific gravity."

The viscosity of the compositions were measured using a Brookfield HATDV II Model II viscometer with a #4 spindle (Brookfield Labs, Stoughton, Mass.). The viscosity was recorded after the compositions were sheared for 90 seconds at a shear rate of 20 rpm. The results are summarized below.

| | | EXAMPLE | |
|---|---|---|---|
| | | A | B |
| Specific gravity (BULK) | | 1.28 | 1.28 |
| Specific gravity (LIQUID) | | 1.28 | 1.28 |
| Viscosity (cP) | 1 day after preparation | 5060 | 4760 |
| Viscosity (cP) | 12 weeks after preparation | 5150 | 6350 |
| Separation (%) | 12 weeks after preparation | 0 | 0 |

The above data demonstrates that the process of the present invention produces a thixotropic liquid automatic detergent composition which is highly stable and not subject to phase separation after long periods of storage.

The invention in its broader aspects is not limited to the specifically described embodiments or example and departures may be made therefrom without departing from the principles of the invention and without sacrificing its chief advantages.

What is claimed is:

1. A process for preparing a scented aqueous thixotropic automatic dishwasher composition which is stable after 12 weeks storage comprising a chlorine bleach stable surfactant, a physical stabilizer selected from the group consisting of long chain fatty acids and their salts and a thixotropic thickener in an amount effective to provide the composition with a thixotropy index of about 2.0 to 10.0; from about 7.5% to about 55% of inorganic components comprising alkali metal tripolyphosphates and sodium silicates and a chlorine bleach compound in an amount of provide about 0.2 to 4% available chlorine; wherein the final composition contains from about 30% to about 70% water and from about 0.01 to 0.4% of a bleach stable fragrance, comprising the steps of:

(a) mixing the surfactant, physical stabilizer and water to form a substantially smooth predispersion;

(b) forming a thickener premix having a solid phase and a liquid phase containing the predispersion from step (a), the thixotropic thickener and water and mixing the premix so that the thickener is substantially hydrate, deagglomerated and dispersed throughout the premix;

(c) mixing a main batch material containing the premix from step (b) and water while adding the sodium silicate and the alkali metal tripolyphosphates;

(d) entraining air bubbles ranging in size from about 5 to about 80 microns in an amount from about 2% to about 10% by volume in the composition so that the composition bulk specific gravity is about equal to the liquid phase specific gravity;

(e) homogenizing the main batch material to deagglomerate any solid particles so as to produce a smooth thixotropic automatic dishwasher composition;

(f) cooling the thixotropic composition to a temperature of less than about 85° F.; and (g) mixing the fragrance with the cooled thixotropic composition from step (f) so as to produce the scented thixotropic dishwasher composition.

2. The process of claim 1 wherein the predispersion is subjected to high-shear mixing.

3. The process of claim 2 wherein the premix is subjected to low-shear mixing.

4. The process of claim 1 wherein from about 4% to about 9% air by volume is entrained in the dishwasher composition.

5. The process of claim 1 wherein from about 6.5% to about 8.5% air by volume is entrained in the dishwasher composition.

6. The process of claim 1 wherein the composition contains at least about 0.1% of a bleach stable surfactant.

7. The process of claim 1 wherein a chlorine bleach stable foam depressant is added in step (a).

8. The process of claim 1 wherein the temperature of the main batch material of step (c) is about 125° to 150° F.

9. The process of claim 1 wherein the bleach stable fragrance is selected from the group consisting of p-cresol methyl ether, dihydrolimonene epoxide, dodecene-1, 2-epoxide, n-undecyl nitrite and mixtures thereof.

10. The process of claim 1 wherein the composition contains from about 0.1% to about 3% thixotropic thickener.

11. The process of claim 10 wherein the thixotropic thickener is a colloid forming clay.

12. The process of claim 10 wherein the clay is a smectite or attapulgite type.

13. The process of claim 1 wherein the fragrance is added continuously to the dishwasher composition by means of a static mixer.

14. The process of claim 1 wherein the scented thixotropic dishwasher composition is adapted to have a specific gravity from about 1.20 to about 1.35.

15. The process of claim 1 wherein the scented thixotropic dishwasher composition is adapted to have a specific gravity from about 1.26 to 1.32.

16. A process for preparing a scented aqueous thixotropic automatic dishwasher composition which is stable after 12 weeks storage comprising at least about 0.01% of a chlorine bleach stable surfactant, and at least about 0.01% of a physical stabilizer selected from the group consisting of long chain fatty acids and their salts; from about 7.5% to about 55% of inorganic components comprising alkali metal tripolyphosphates and sodium silicates; from about 0.1% to about 3% of a thixotropic thickener and a chlorine bleach compound in an amount to provide about 0.2 to 4% available chlorine; wherein the final composition contains from about 30% to about 70% water; and wherein the final composition contains from about 0.01 to about 0.04% of a bleach stable fragrance, comprising the steps of:

(a) high-shear mixing the surfactant, physical stabilizer and water to form a substantially smooth predispersion;

(b) low-shear mixing a premix having a solid phase and a liquid phase containing the predispersion from step (a), the thixotropic thickener and water so that the thickener is substantially hydrated, deagglomerated and dispersed throughout the premix;

(c) mixing a main batch material containing the premix from step (b) and water while adding in sequence the sodium silicate, and the alkali metal tripolyphosphates;

(d) entraining air bubbles ranging in size from about 5 to about 80 microns in an amount from about 2% to about 10% by volume in the composition so that the composition bulk specific gravity is about equal to the liquid phase specific gravity;

(e) homogenizing the main batch material to deagglomerate any solid particles so as to produce a smooth thixotropic automatic dishwasher composition;

(f) cooling the thixotropic composition to a temperature of less than about 85° F.; and (g) mixing the fragrance with the cooled thixotropic composition from step (f) so as to produce the scented thixotropic dishwasher composition.

17. The process of claim 16 wherein the thixotropic thickener is a colloid-forming clay.

18. The process of claim 16 wherein the clay is a smectite or attapulgite type.

19. The process of claim 16 wherein the bleach stable fragrance is selected from the group consisting of p-cresol methyl ether, dihydrolimonene epoxide, dodecene-1, 2-epoxide, n-undecyl nitrite and mixtures thereof.

20. The process of claim 16 wherein from about 4% to about 9% air by volume is entrained in the dishwasher composition.

21. The process of claim 16 wherein from about 6.5% to about 8.5% air by volume is entrained in the dishwasher composition.

22. The process of claim 16 wherein the fragrance is added continuously to the dishwasher composition by means of a static mixer.

23. The process of claim 16 wherein the scented thixotropic dishwasher composition is adapted to have a specific gravity from about 1.20 to about 1.35.

24. The process of claim 16 wherein the scented thixotropic dishwasher composition is adapted to have a specific gravity from about 1.26 to 1.32.

25. An aqueous thixotropic automatic dishwasher composition which is stable after 12 weeks storage comprising:

(a) 5 to 35% alkali metal tripolyphosphate;

(b) 0 to 50% sodium silicate;

(c) 0 to 9% alkali metal carbonate;

(d) 0 to 5% chlorine bleach stable, water dispersible organic detergent active material;

(e) 0 to 5% chlorine bleach stable foam depressant;

(f) a chlorine bleach compound in an amount effective to provide about 0.2 to 4% of available chlorine;

(g) a long chain fatty acid or its salt in an amount effective to increase the physical stability of the composition;

(h) thixotropic thickener in an amount effective to provide the composition with a thixotropy index of about 2.0 to 10.0;

(i) air in an amount ranging from about 2% to about 10% by volume in the form of bubbles ranging in size from about 5 to about 80 microns whereby the composition bulk specific gravity is about equal to the liquid phase specific gravity;

(j) fragrance in an amount effective to impart a pleasant scent to the composition without adversely affecting the phase stability or the desired thixotropic properties said fragrance being added to the composition of steps (a)–(i) at a temperature of less than 85° F.; and (k) water in an amount effective to avoid destruction of the desired thixotropic properties.

26. The composition of claim 25 wherein the air (i) is present in an amount such that the bulk specific gravity of the dishwasher detergent composition is about equal to the liquid phase specific gravity of the dishwasher detergent composition.

27. The composition of claim 26 adapted to have a specific gravity of from about 1.20 to about 1.35.

28. An aqueous thixotropic automatic dishwasher composition comprising from about 2% to about 10% by volume air in the form of bubbles ranging in size from about 5 to about 80 microns so that the composition bulk specific gravity is about equal to the liquid phase specific gravity which is stable after 12 weeks storage and comprising approximately by weight:

(a) 5 to 35% alkali metal tripolyphosphate;

(b) 2.5 to 20% sodium silicate;

(c) 0 to 9% alkali metal carbonate;

(d) 0.1 to 5% chlorine bleach stable, water dispersible organic detergent active material;

(e) 0 to 5% chlorine bleach stable foam depressant;

(f) a chlorine bleach compound in an amount to provide about 0.2 to 4% of available chlorine;

(g) a long chain fatty acid or its salt as a physical stabilizer in an amount effective to increase the physical stability of the composition;

(h) thixotropic thickener in an amount effective to provide the composition with a thixotropy index of about 2.0 to 10.0;

(i) fragrance in an amount effective to impart a pleasant scent to the composition without adversely affecting the phase stability or the desired thixotropic properties; and (j) water in an amount effective to avoid destruction of the desired thixotropic properties.

29. The composition of claim 28 wherein the physical stabilizer (g) is present in an amount from about 0.01 to about 1.0%.

30. The composition of claim 28 wherein the physical stabilizer (g) is an aliphatic long chain fatty acid or its metal salt.

31. The composition of claim 28 wherein the thixotropic thickener (h) is present in an amount from about 0.1 to about 10%.

32. The composition of claim 28 wherein the fragrance (i) is present in an amount from about 0.01 to about 0.4%.

33. The composition of claim 28 wherein the fragrance (i) is present in an amount from about 0.02 to about 0.2%.

34. The composition of claim 28 wherein the foam depressant (e) is present in an amount from about 0.01 to 5%.

35. The composition of claim 31 or 32 wherein the fragrance is selected from the group consisting of p-cresol methyl ether, dihydrolimonene epoxide, dodecene-1, 2-epoxide, n-undecyl nitrile and mixtures thereof.

36. The composition of claim 28 adapted to have a specific gravity of from about 1.20 to about 1.35.

37. The composition of claim 28 adapted to have a specific gravity of from about 1.26 to about 1.32.

38. The composition of claim 28 wherein the organic detergent active material is selected from the class consisting of branched alkali metal mono-and di-$C_{8-14}$ alkyl diphenyl oxide mono- and disulfonates and linear alkali metal mono-and di-$C_{8-14}$ alkyl diphenyl oxide mono- and disulfonates.

39. The composition of claim 28 wherein the foam depressant is selected from the class consisting of alkyl phosphonic acid esters and alkyl acid phosphate esters.

40. The process of claim 7 wherein the composition contains at least about 0.01% of a bleach stable foam depressant.

41. The process of claim 40 wherein the composition contains at least about 0.01% of a physical stabilizer selected from the group consisting of long chain fatty acids and their salts.

42. The process of claim 18 wherein at least about 0.01% of a chlorine bleach stable foam depressant is added in step (a).

43. The process of claim 16 wherein the temperature of the main batch material of step (c) is about 125° to 150° F.

* * * * *